US012102901B2

(12) United States Patent
Barber

(10) Patent No.: US 12,102,901 B2
(45) Date of Patent: Oct. 1, 2024

(54) STEP-ACTIVATED BALL TOSSING APPARATUS

(71) Applicant: Jeremiah Barber, St. George, UT (US)

(72) Inventor: Jeremiah Barber, St. George, UT (US)

( * ) Notice: Subject to any disclaimer, the term of this patent is extended or adjusted under 35 U.S.C. 154(b) by 82 days.

(21) Appl. No.: 18/057,573

(22) Filed: Nov. 21, 2022

(65) Prior Publication Data

US 2023/0181991 A1 Jun. 15, 2023

Related U.S. Application Data

(60) Provisional application No. 63/288,277, filed on Dec. 10, 2021.

(51) Int. Cl.
*A63B 69/40* (2006.01)
*A63B 69/00* (2006.01)
*A63B 102/18* (2015.01)

(52) U.S. Cl.
CPC ..... *A63B 69/40* (2013.01); *A63B 69/0002* (2013.01); *A63B 2069/0008* (2013.01); *A63B 2069/401* (2013.01); *A63B 2102/18* (2015.10); *A63B 2102/182* (2015.10); *A63B 2214/00* (2020.08)

(58) Field of Classification Search
CPC ..... A63B 69/40; A63B 69/0002; A63B 2069/0008; A63B 2069/401; A63B 2102/18; A63B 2102/181; A63B 2214/00; A63B 2210/50; A63B 67/12; A01K 39/014; A01K 15/025; A01K 15/027; E05D 1/00; F41B 5/03
USPC ..... 16/252, 267, 270
See application file for complete search history.

(56) References Cited

U.S. PATENT DOCUMENTS 4,010,953 A * 3/1977 Russo ..... A63F 7/0612 124/4
4,402,507 A * 9/1983 Hudson ..... A63B 69/40 124/16
5,357,565 A * 10/1994 Butler, III ..... E05D 11/0054 16/250
6,718,961 B1 * 4/2004 Woods ..... F41B 3/03 473/438
7,114,465 B1 * 10/2006 Winter ..... A01K 15/025 119/707
9,392,768 B1 * 7/2016 Mullin ..... F41B 3/04
10,150,022 B1 * 12/2018 Robino ..... A63B 65/122
2009/0176602 A1 * 7/2009 Masters ..... A63B 69/0002 473/451
2012/0006309 A1 * 1/2012 Levin ..... A01K 39/014 124/5
2012/0227721 A1 * 9/2012 Geller ..... A63B 60/10 124/5
2016/0096095 A1 * 4/2016 Williams ..... A63B 60/34 124/5

(Continued)

*Primary Examiner* — John E Simms, Jr.
(74) *Attorney, Agent, or Firm* — Gurr Brande & Spendlove, PLLC; Robert A. Gurr

(57) ABSTRACT

A ball tossing device has a base and a lever, with the lever having a foot portion and a tossing portion, and the base acting as a fulcrum for the lever. In some examples, the foot portion and the tossing portion may be removably coupled to one another. In some examples, a method of using the ball tossing device includes a user placing a ball on the tossing portion, stomping a foot on the foot portion, thereby actuating the lever and tossing the ball upward from the tossing portion, and then hitting the ball with a bat.

6 Claims, 13 Drawing Sheets

(56) References Cited

U.S. PATENT DOCUMENTS

2018/0236331 A1* 8/2018 Valencia ..... A63B 67/06

* cited by examiner

STEP-ACTIVATED BALL TOSSING APPARATUS

CROSS-REFERENCE TO RELATED APPLICATIONS

This application claims the benefit of U.S. Provisional Application Ser. No. 63/288,277, filed on Dec. 10, 2021, which is incorporated herein by reference.

TECHNICAL FIELD

The present disclosure relates to baseball and softball. More particularly, the present disclosure relates to pitching devices for swing practice.

BACKGROUND

Baseball is America's pastime and is regarded as the first professional sport in the United States. As a result, baseball and softball games are played at all ages and levels in virtually every city in the U.S. Players who want to improve their batting game often find that they must practice alone, which is complicated due to the requirement for both a pitcher and a batter. To solve this need, various devices have been invented over the years. One of the most common devices for batting practice is a batting tee. A tee holds the ball at a predetermined height, allowing a user to place a ball on the tee and then swing to hit the ball. While this is helpful for beginners, because the ball is motionless and at the same height, it lacks the realism sought by more advanced batters.

To be more realistic, other pitching devices have entered the market. These machines are typically pre-loaded with several balls and are placed at a distance to the batter, effectively pitching the ball to the batter. However, pitching machines usable by a single player are expensive and require a power source. Further, the rate of the pitch is also determined by the machine with few settings for variation. If a batter wishes to change the pitch, they must quickly approach the machine, likely while it is still pitching, to make adjustments. While these machines can be more realistic, their cost and difficulty of use makes them unobtainable and unusable for many, particularly if there is no readily available power source at the practice location.

Accordingly, there is a need for a pitching/tossing device that is inexpensive, easy to use, does not require power, and that still provides a realistic pitch (e.g., motion and variance in position). The present disclosure seeks to solve these and other problems.

SUMMARY OF EXAMPLE EMBODIMENTS

In some embodiments, a ball tossing device comprises a base and a lever, the lever comprising a foot portion and a tossing portion, and the base acting as a fulcrum for the lever. In some embodiments, the foot portion and the tossing portion may be removably coupled to one another.

In some embodiments, a method of using the ball tossing device comprises a user placing a ball on the tossing portion, stomping a foot on the foot portion, thereby actuating the lever and tossing the ball upward from the tossing portion, and then hitting the ball with a bat.

DETAILED DESCRIPTION OF EXAMPLE EMBODIMENTS

Figure 1:
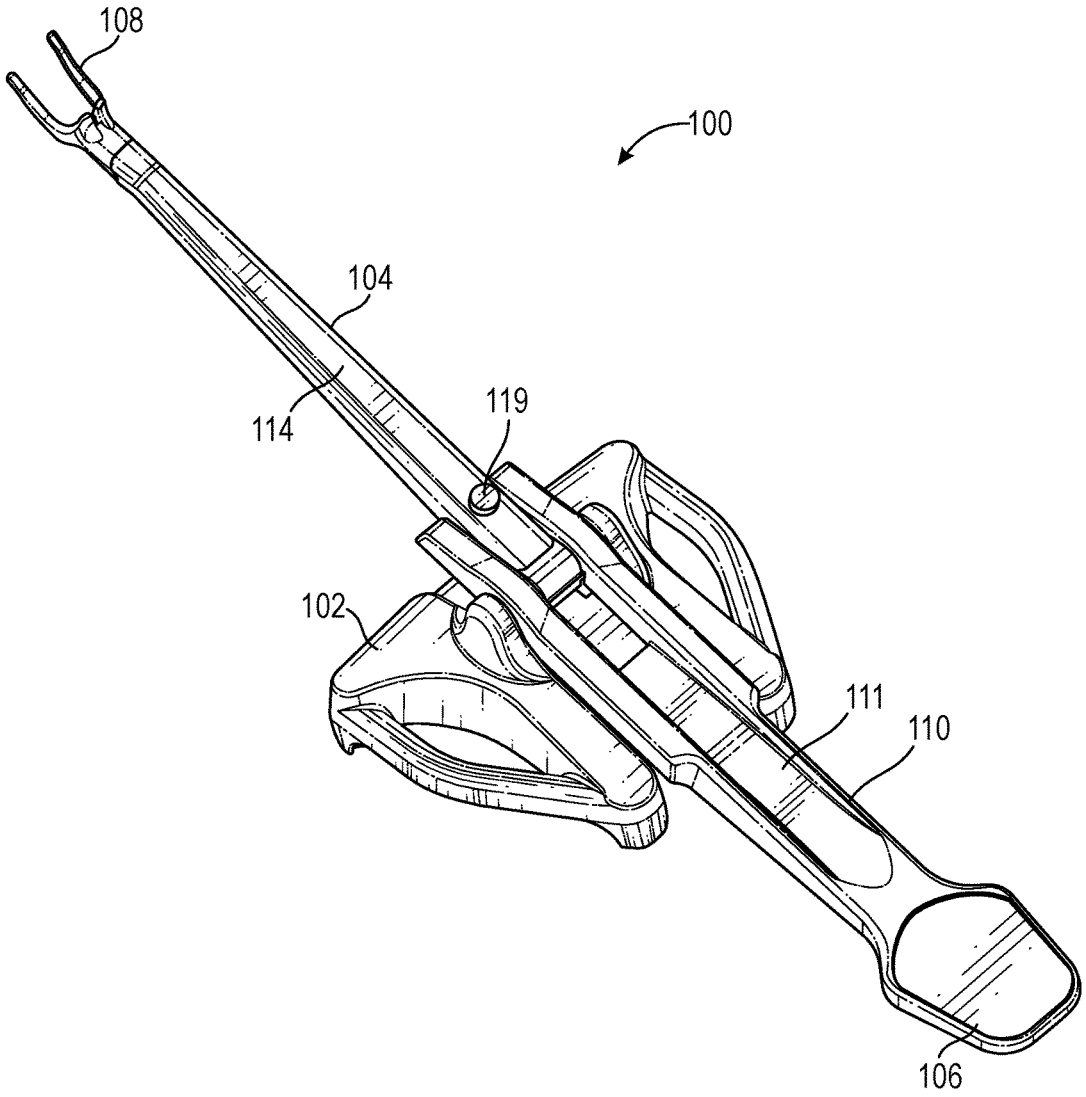
FIG. 1 illustrates a top, left perspective view of a ball tossing device.
Figure 2:
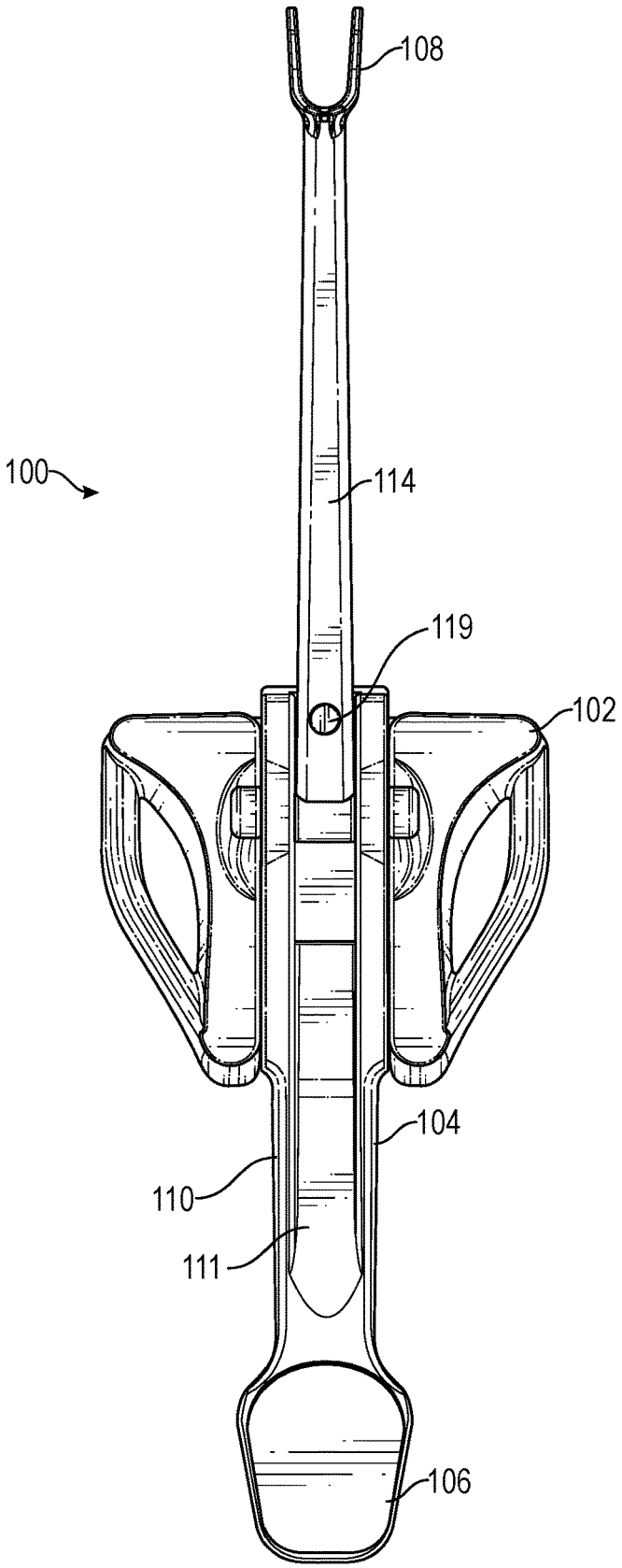
FIG. 2 illustrates a top plan view of a ball tossing device.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a pitching/tossing device that is inexpensive, easy to use, does not require power, and that still provides a realistic pitch (e.g., motion and variance in position). The ball tossing device disclosed herein solves these problems and others.

In some embodiments, as shown in FIGS. 1-11, a ball tossing device 100 comprises a base 102 and a lever 104. The lever 104 comprises a foot portion 106 and a tossing portion 108. In some embodiments, as best shown in FIGS. 5-8, the foot portion 106 and the tossing portion 108 may be removably coupled to one another. For example, the foot portion 106 comprises a first arm 110 comprising a first coupling end 112, and the tossing portion 108 comprises a second arm 114 comprising a second coupling end 116. The first coupling end 112 of the first arm 110 comprises a pivot rod 118. The second coupling end 116 of the second arm 114 comprises a rod aperture 120 for mating with the pivot rod 118. To secure the second coupling end 116 to the first coupling end 112, a coupling plate 122 may be used. The coupling plate 122 may be positioned on an underside of the pivot rod 118 and may be secured via screws 125 (best seen in FIG. 7) or otherwise secured to the underside of the second coupling end 116, thereby coupling the first coupling end 112 to the second coupling end 116 around the pivot rod 118.

Figure 11:
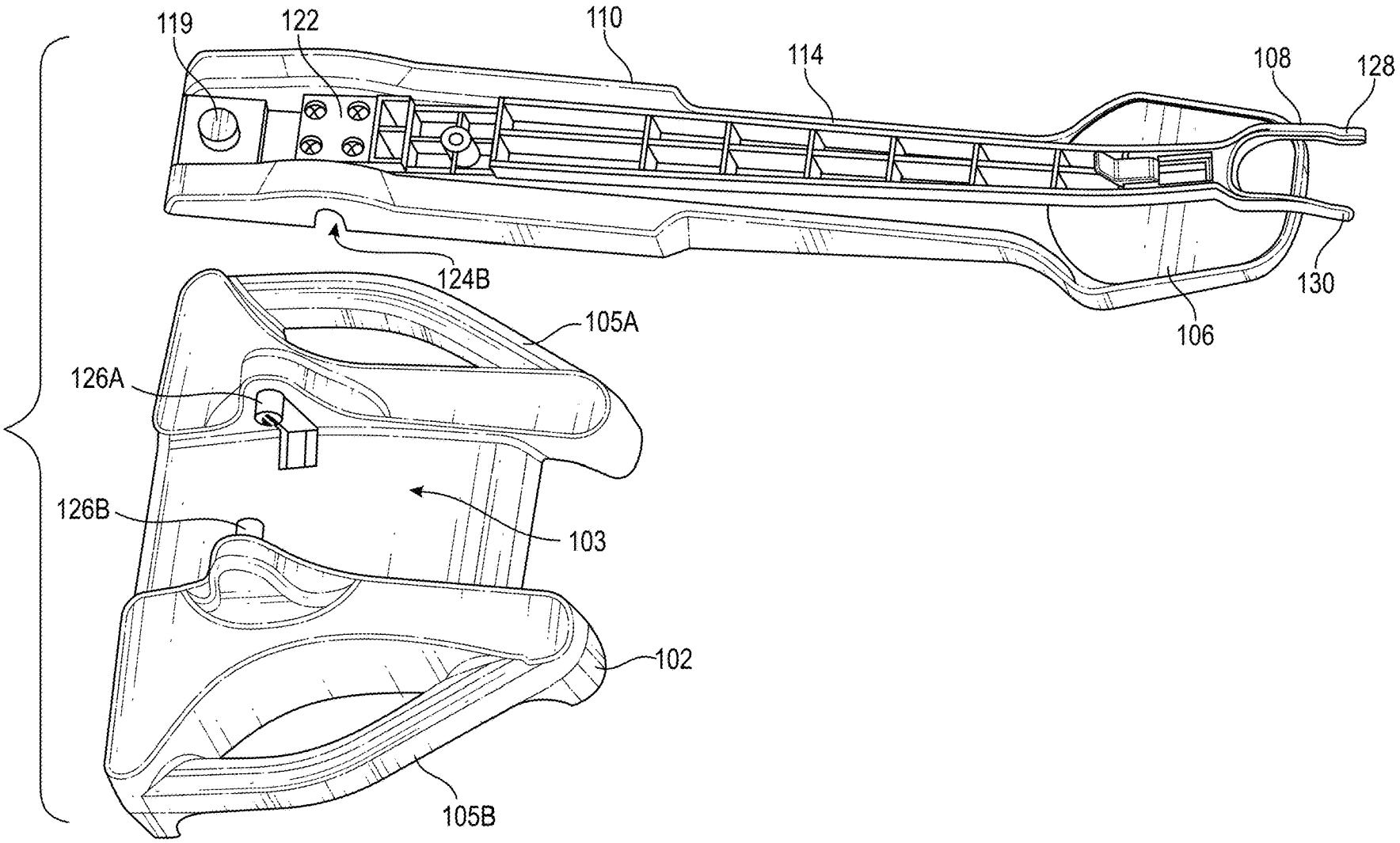
FIG. 11 illustrates a folded lever decoupled from a base of a ball tossing device.

As shown in FIG. 11, by being coupled around the pivot rod 118, the second arm 114 may pivot in relation to the first arm 110 on the pivot rod 118, allowing the second arm 114 to contact the first arm 110 longitudinally. In other words, the arms 110, 114 may be "folded" together for easy transport and storage. As shown, the first arm 110 may comprise a groove 111 for receiving the second arm 114 when pivoted to a closed position. Before use, a user would pivot the second arm 114 in relation to the first arm 110 to an extended position, forming the lever 104. To prevent the second arm 114 from unintentionally pivoting during use, a thumb screw 119 (or pin, bolt, or other fastening mechanism) may be secured through a second aperture 121 (best seen in FIG. 8) of the second arm 114 and through a first aperture 123 of the first arm 110. This secures the arms 110, 114 in an extended position, ready for use, as shown in FIGS. 1-4.

Figure 7:
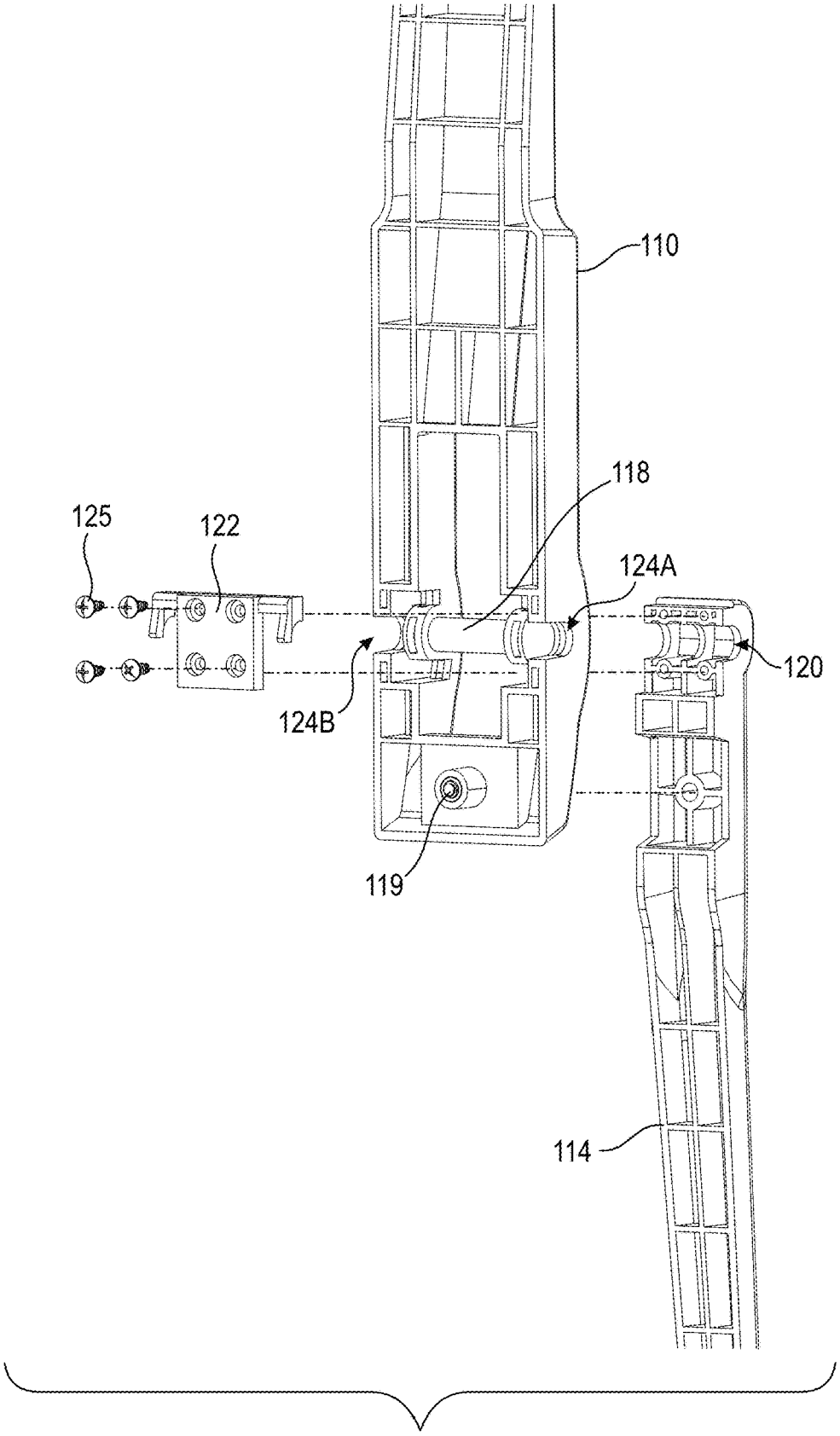
FIG. 7 is a detailed bottom perspective view of a disassembled lever of a ball tossing device.
Figure 8:
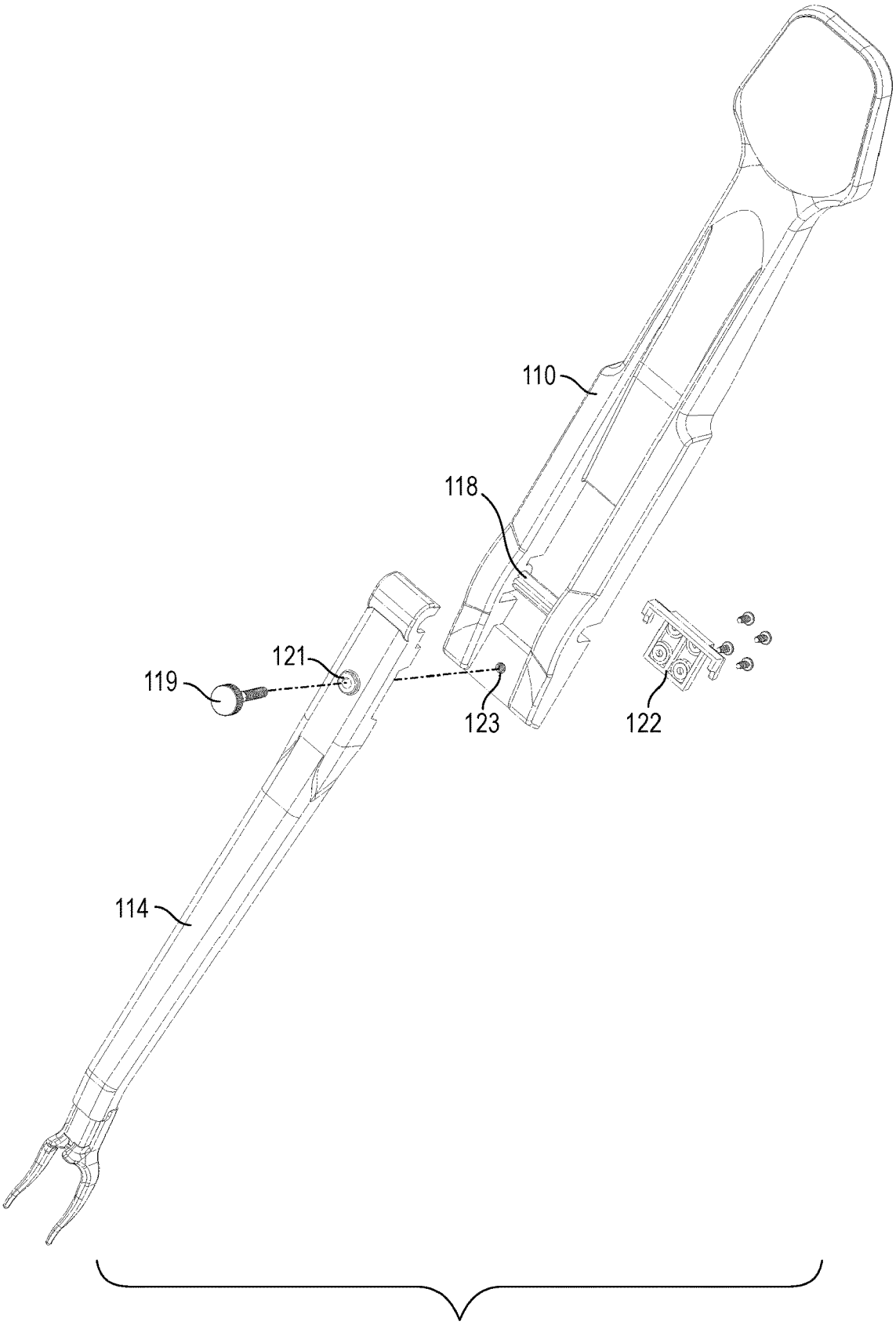
FIG. 8 illustrates a top, left side perspective view of a disassembled lever of a ball tossing device.
Figure 9:
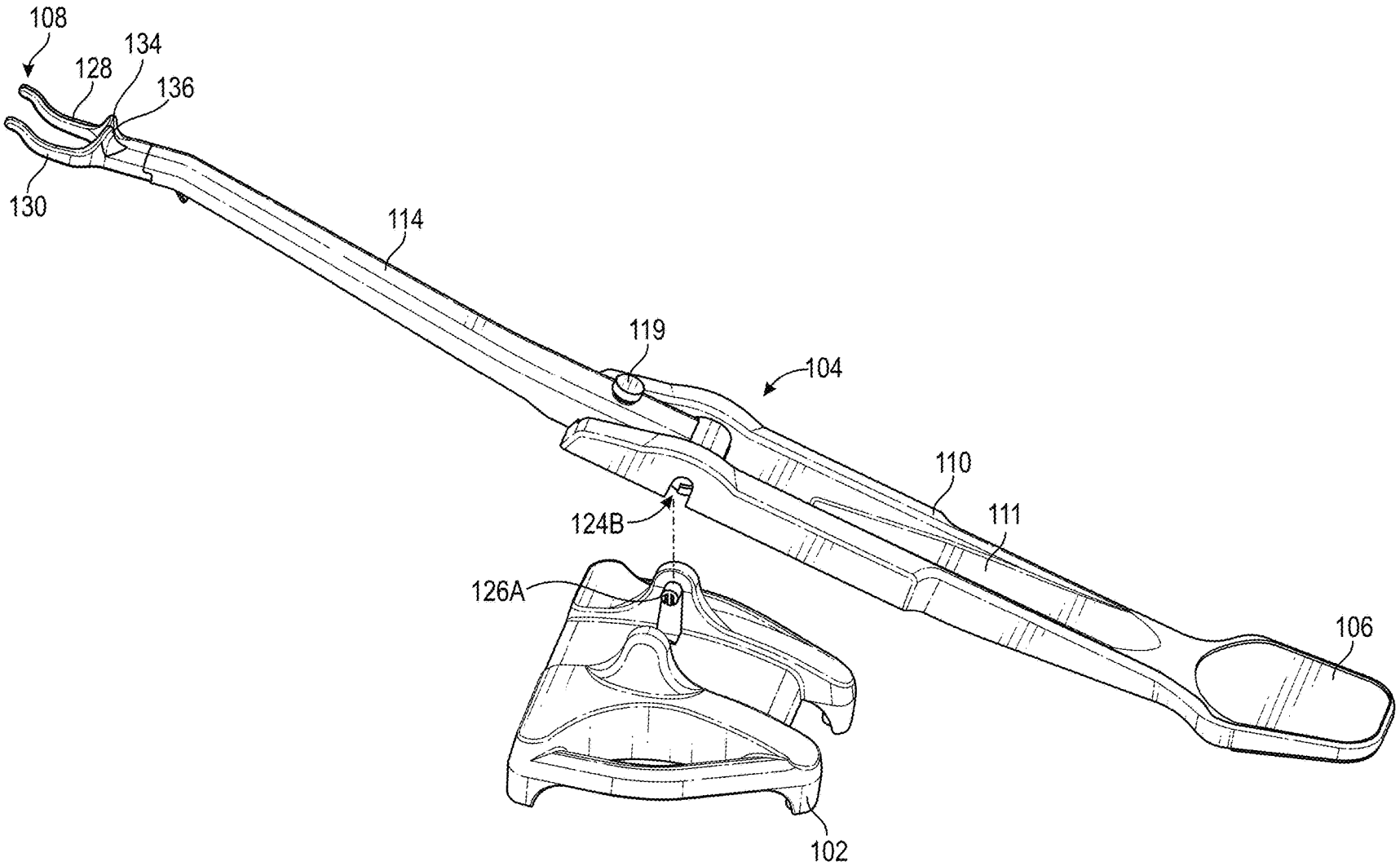
FIG. 9 illustrates a left side perspective view of a lever decoupled from a base of a ball tossing device.

Referring to FIGS. 7, 9 and 11, once the first arm 110 is coupled to the second arm 114 forming the lever 104, the lever 104 may then be coupled to the base 102. The first arm 110 comprises fulcrum apertures 124A-B for receiving base rods 126A-B. Once the fulcrum apertures 124A-B are mated with the base rods 126A-B, respectively, the lever 104 is freely pivotable on the base 102. In other words, the fulcrum apertures 124A-B are configured to pivot on the base rods 126A-B, allowing the lever 104 to pivot on the base 102. While two base rods 126A-B are illustrated, it will be appreciated that one rod would suffice.

Figure 10:
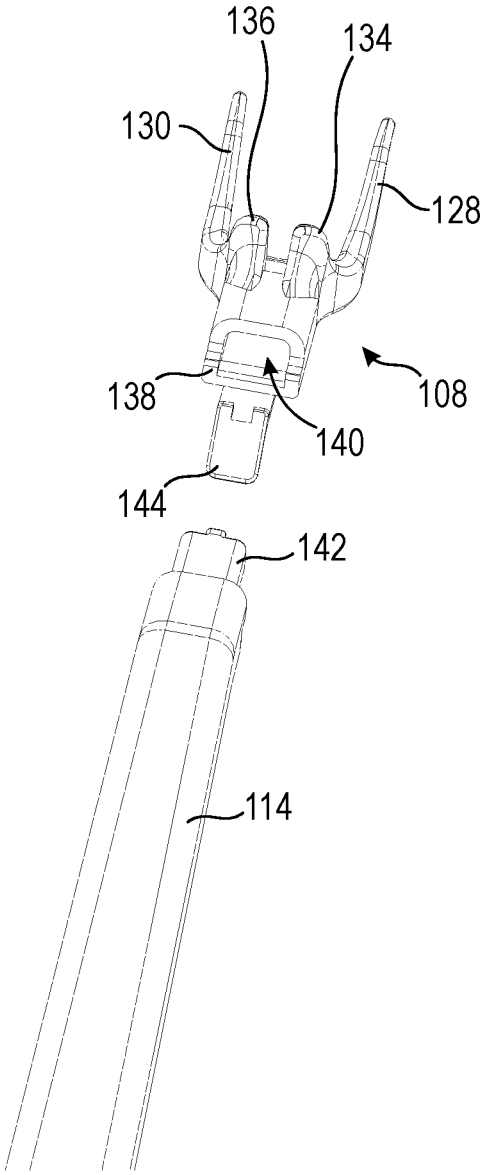
FIG. 10 illustrates a detailed, top perspective view of a tossing portion decoupled from an arm of a ball tossing device.

Referring to FIGS. 9-10, in some embodiments, the tossing portion 108 may comprise a first finger 128 and a second finger 130 for cradling the ball. Each finger 128, 130 may be curved so as to complement the shape of a ball. While two fingers 128, 130 are shown, it will be appreciated that more may be used. Additionally, in some embodiments, the tossing portion 108 may not comprise fingers 128, 130, but may instead comprise a platform or cupped portion for cradling a ball 132 (ball shown in FIG. 12). Additionally, in some embodiments, the tossing portion 108 may further comprise a first ball-abutting protrusion 134 and a second ball-abutting protrusion 136. The first ball-abutting protrusion 134 may be positioned at the base of the first finger 128 and the second ball-abutting protrusion 136 may be positioned at the base of the second finger 130. Accordingly, the ball 132 is cradled between the fingers 128, 130 and the ball-abutting protrusions 134, 136, preventing the ball 134 from prematurely leaving the ball tossing portion 108.

Referring to FIG. 10, the tossing portion 108 may be removably attachable to the second arm 114. For example, the tossing portion 108 may comprise a base 138 comprising a channel 140 or other aperture for receiving a male portion 142 of the second arm 114. A release lever 144 may be used to release the tossing portion 108 from the second arm 114. This allows a user to exchange the tossing portion 108 for other tossing portions or members for use with varying-sized balls. For example, a first user may prefer a baseball while a second user may prefer a softball. Due to the difference in size, it may be preferable to have a tossing portion 108 sized to accommodate each size of ball. Accordingly, a user may simply actuate the release lever 144 to uncouple the tossing portion 108 from the second arm 114 and then attach a different tossing portion 108.

Further, even if used with the same sized ball, it may be preferable to have varying positions of the fingers 128, 130 and/or the ball-abutting protrusions 134, 136 so as to achieve different ball positioning results when a user is using the ball tossing device 100. In some instances, the length of the tossing portion 108 may vary, accounting for different arm lengths and swings of users. Further, the second arm 114 may also be elongated or shortened, with each user able to customize for their use by coupling their desired length of second arm 114 to the first arm 110. While a release lever 144 is shown and described, it will be appreciated that other removably attachable coupling mechanisms may be used, such as spring-loaded pins, clips, locking pins, etc.

Additionally, while the foot portion 106 is generally shown as flat, it will be appreciated that other formfactors may be used without departing herefrom. The ball tossing device 100 may be made from plastics, metals, woods, fiberglass, carbon fiber, or any other suitable material. Additionally, the base 102 may comprise non-slip pads, feet, or surfaces, and the foot portion 106 may also comprise non-slip surfaces and/or pads.

Referring to FIG. 11, the base 102 may comprise a groove 103 sized so as to receive the lever 104 therein, thereby allowing the lever 104 to pivot without hitting the base 102. The base 102 may further comprise one or more handles 105A-B for easy transport.

Figure 12:
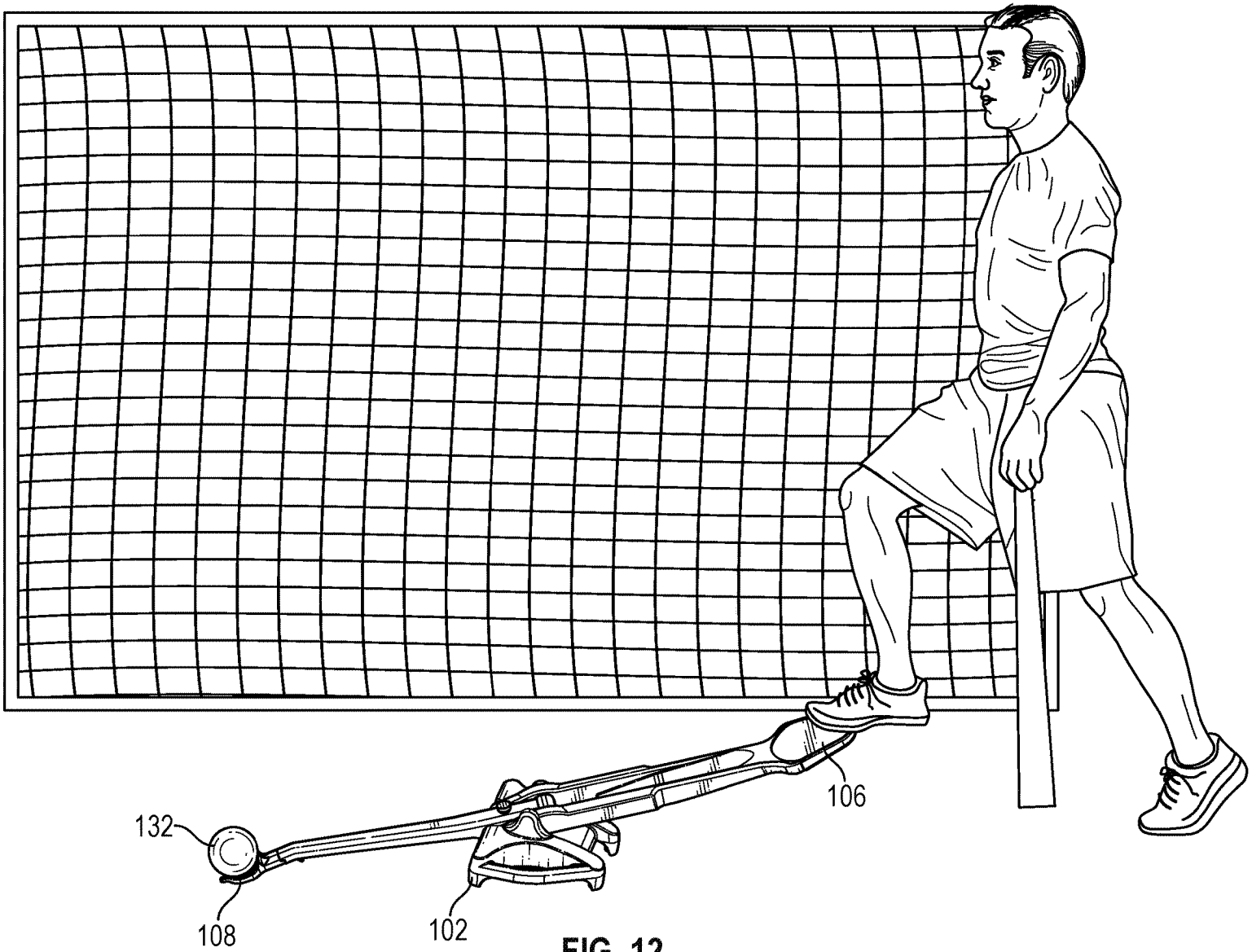
FIG. 12 illustrates a user preparing to actuate a lever of a ball tossing device.
Figure 13:
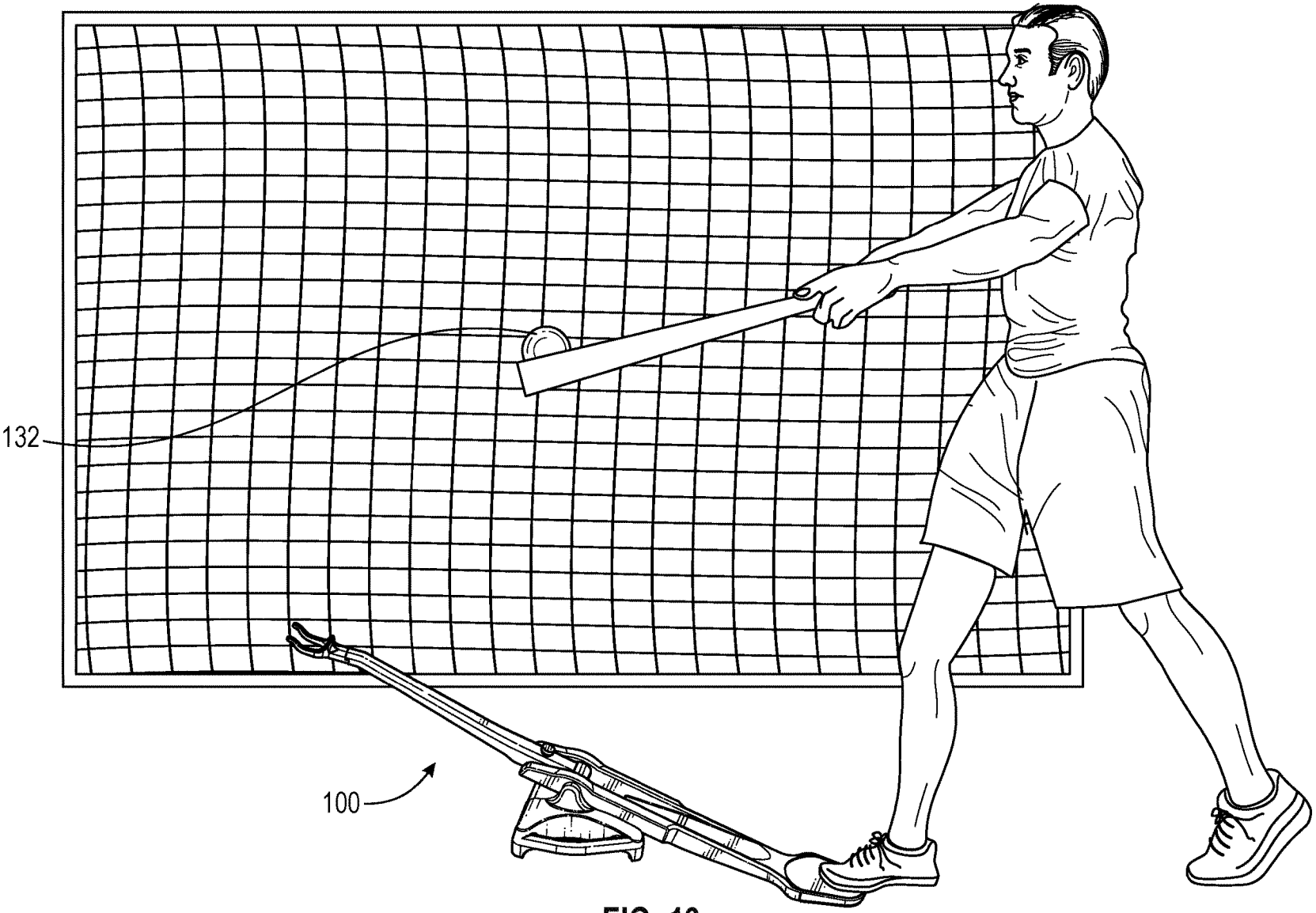
FIG. 13 illustrates a ball tossing device having been actuated by a user, the ball tossed vertically and the user swinging to hit the ball.

Referring to FIGS. 12-13, in some embodiments, a method of using the ball tossing device 100 comprises a user placing a ball 132 (e.g., baseball, softball, etc.) on the tossing portion 108. The weight of the ball 132 causes the tossing portion 108 to rest on the ground, resulting in the foot portion 108 being elevated from the ground, as shown in FIG. 12. With the foot portion 106 now elevated, a user may stomp a foot on the foot portion 106, thereby actuating the lever 104 on the base 102, tossing the ball 132 upward from the tossing portion 108, as shown in FIG. 13. It will be appreciated that a user may vary the force of each stomp, causing the ball 132 to be tossed to varying heights each time. This approximates a more realistic game setting because the position and speed vary with each stomp. Additionally, foot, hand, and eye coordination are improved, helping the user to improve their swing and gameplay.

Figure 3:
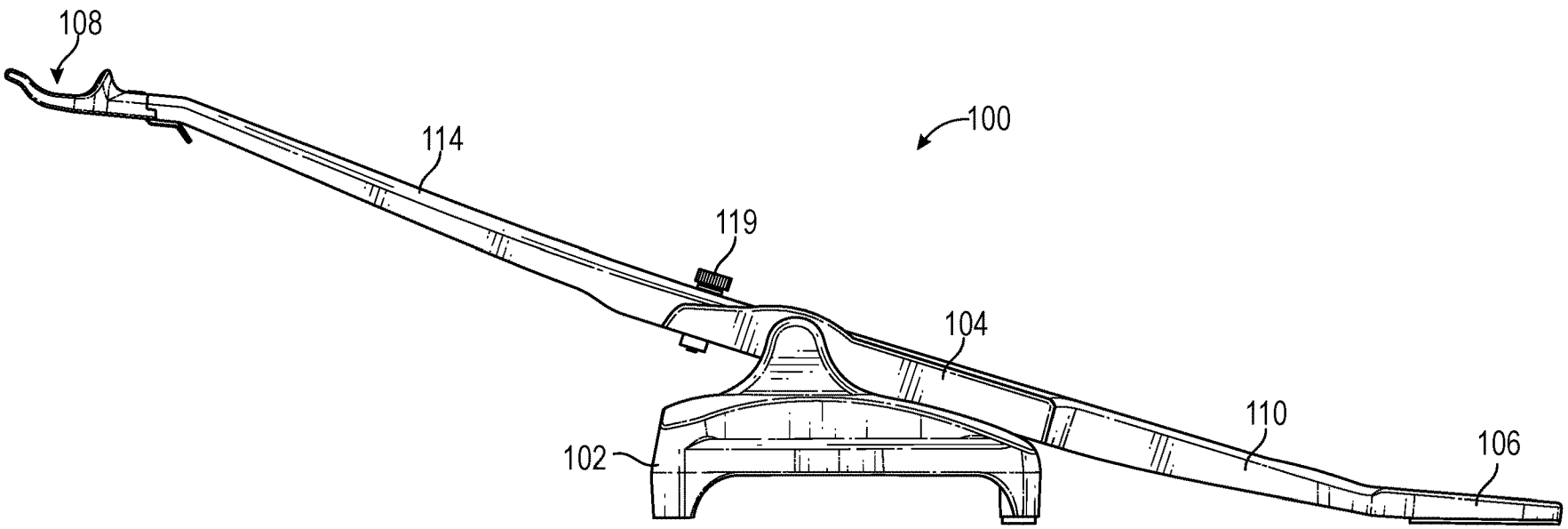
FIG. 3 illustrates a left side elevation view of a ball tossing device, the right side being a mirror image thereof.
Figure 4:
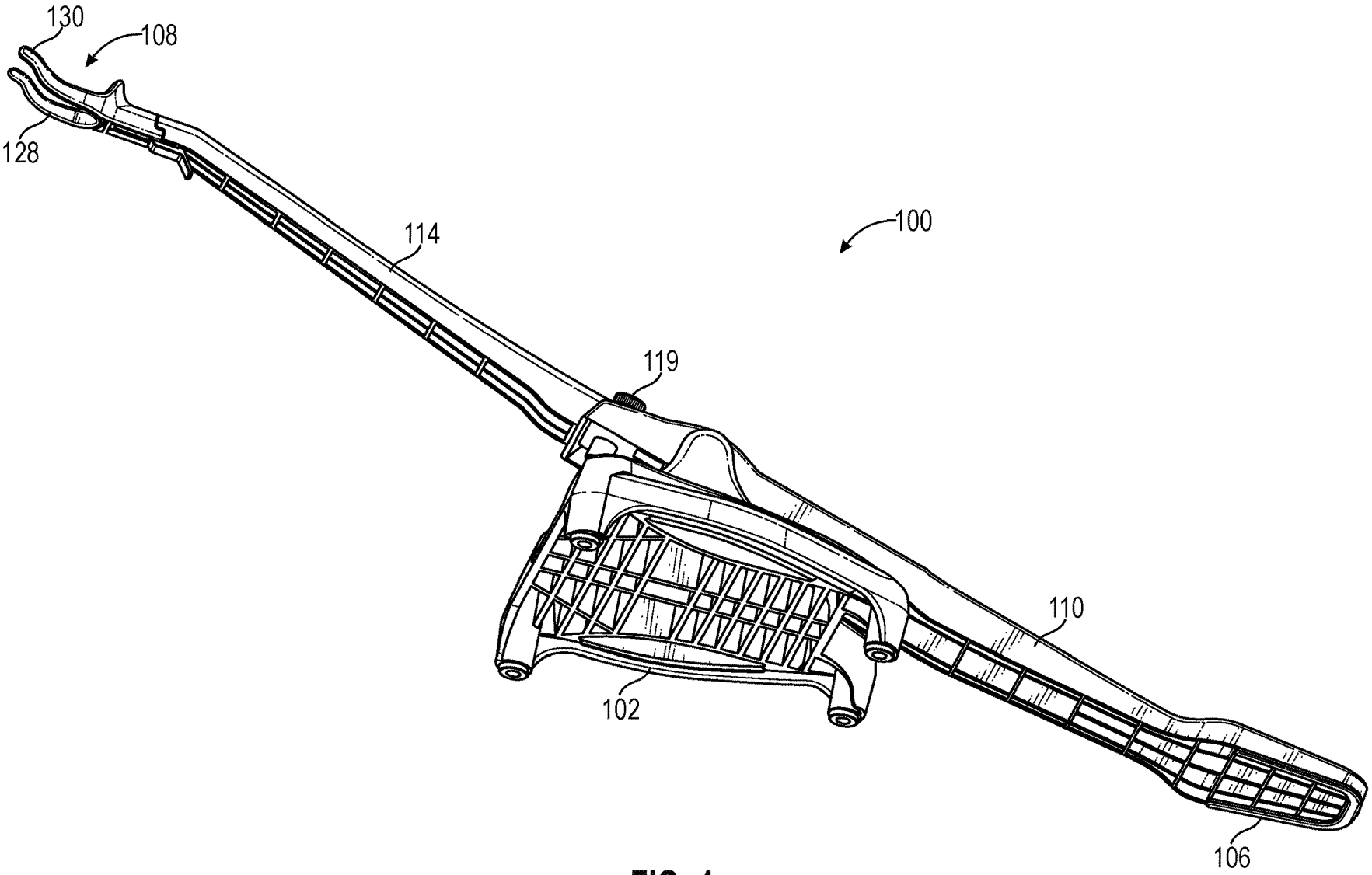
FIG. 4 illustrates a bottom, left side perspective view of a ball tossing device.
Figure 5:
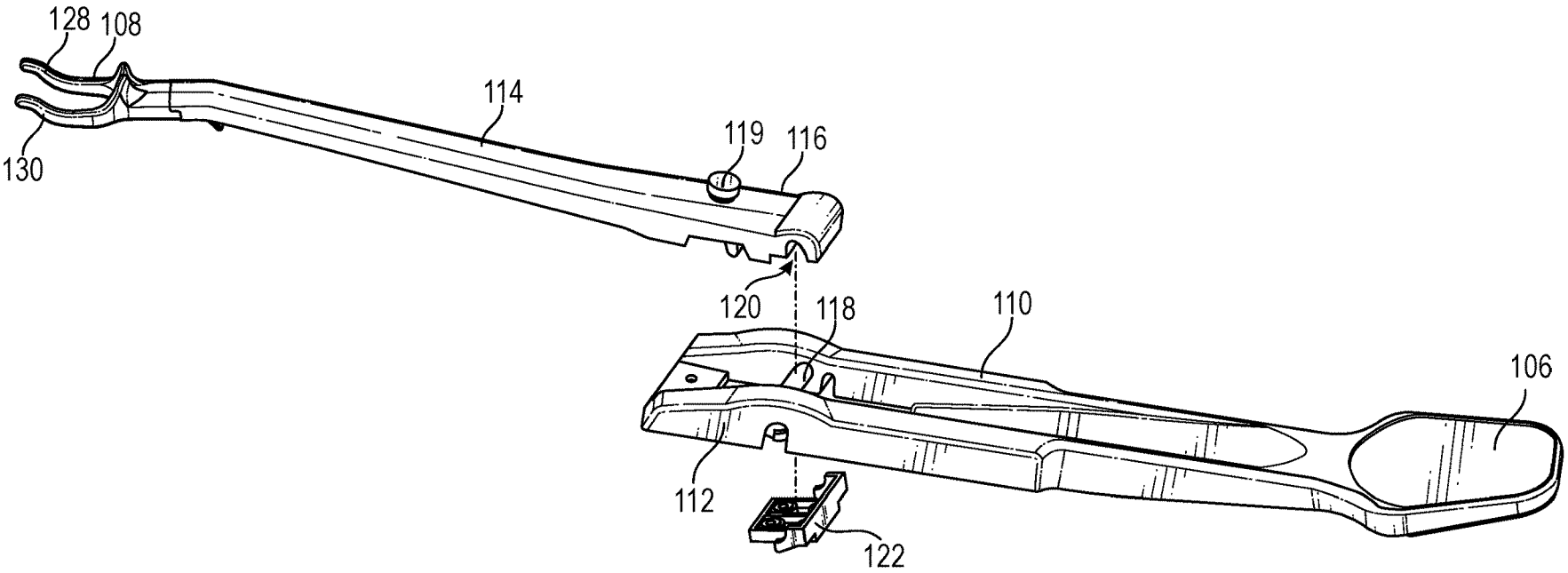
FIG. 5 illustrates a left side perspective view of a disassembled lever of a ball tossing device.
Figure 6:
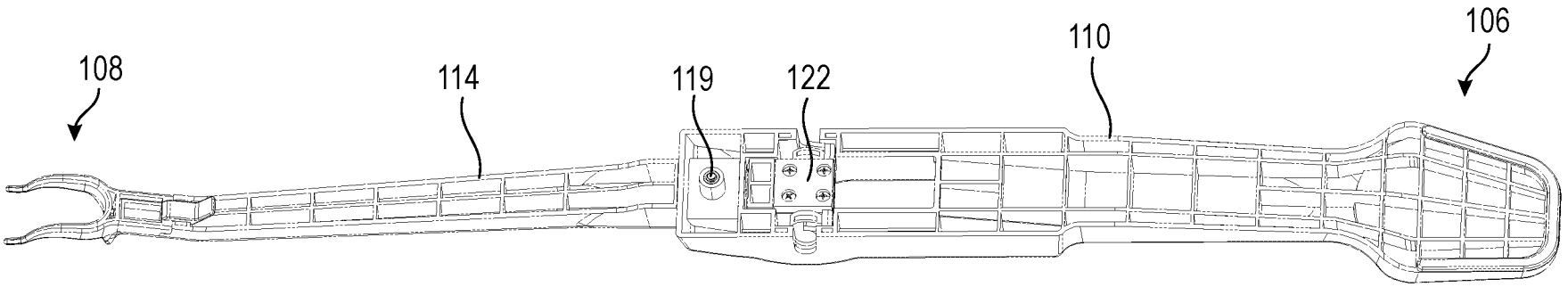
FIG. 6 illustrates a bottom perspective view of a disassembled lever of a ball tossing device.

In some embodiments, as best seen in FIG. 3, the fingers of tossing portion 108 may be contoured at their distal ends (distal to the second arm 114) so as to allow the ball 132 to more easily roll off the end, ensuring a better vertical projection.

While the lever 104 is generally shown as comprising a first arm 110 coupled to a second arm 114, such a configuration is not required. Indeed, the lever 104 may be of single manufacture from the foot portion 106 to the tossing portion 108. Additionally, while the lever 104 has been shown and described as being removable from the base 102, that is likewise not required and the lever 104 may be more permanently affixed to the base 102 while still remaining pivotable.

As appreciated from the foregoing, the ball tossing device 100 disclosed herein solves the need for a pitching device that is inexpensive, easy to use, does not require power, and that still provides a realistic pitch.

It will be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A ball tossing device, comprising:

a base comprising a groove and a first base rod and a second base rod each positioned within opposing sides of the groove;

a lever configured to pivotally couple to the first and second base rods of the base, the lever comprising:

a first arm comprising:

a foot portion at a first end, a second end comprising a first fulcrum aperture opposite a second fulcrum aperture, the first fulcrum aperture configured to receive the first base rod and the second fulcrum aperture configured to receive the second base rod, the first and second fulcrum apertures remaining pivotable on the first and second base rods, respectively, a pivot rod interposed between the first and second fulcrum apertures, and a first fastening aperture for receiving a thumb screw;

a second arm comprising:

a tossing portion at a first end, a pivot rod aperture at a second end, the pivot rod aperture configured to receive a first side of the pivot rod of the first arm, a coupling plate positioned on a second side of the pivot rod, the coupling plate secured to the second arm via a plurality of screws, wherein the second arm is configured to pivot around the pivot rod, and a second fastening aperture configured to selectively align with the first fastening aperture; and the tossing portion comprising:

a first finger on a first side and a second finger on a second side, and a first ball-abutting protrusion and a second ball-abutting protrusion, each positioned between the first and second fingers, the first and second fingers and the first and second ball-abutting protrusions cooperating to propel a ball vertically therefrom;

wherein in a first, extended position, the first and second fastening apertures are aligned and a thumb screw is configured to be threaded through the second fastening aperture and into the first fastening aperture to thereby secure the first arm and second arm extending in a longitudinal direction from one another, and wherein in a second, closed position, the second arm longitudinally abuts the first arm, the thumb screw configured to be received in the first fastening aperture.

2. The ball tossing device of claim 1, wherein the first arm further comprises a groove for receiving the second arm when in the second, closed position.

3. The ball tossing device of claim 2, wherein the first and second fingers each comprise divergent, contoured distal ends.

4. The ball tossing device of claim 2, wherein the tossing portion comprises a base, a channel in the base, and a release lever, and the second arm comprises a male portion configured to insert into the channel of the base.

5. A method of using a ball tossing device to toss a ball, the method comprising:

pivoting a second arm from within a channel of a first arm to form a lever in an extended position, the second arm pivoting on a pivot rod aperture receiving a pivot rod of the first arm, the second arm remaining pivotably coupled to the pivot rod via a coupling plate secured to the second arm and positioned on an opposite side of the pivot rod in relation to the second arm;

securing the second arm in the extended position by inserting a thumb screw through a second fastening protrusion of the second arm and into a first fastening protrusion of the first arm;

pivotably coupling the first arm to a base by inserting a first base rod of the base into a first fulcrum aperture of the first arm and simultaneously inserting a second base rod of the base into a second fulcrum aperture of the first arm;

placing the ball on a tossing portion of the second arm of the lever, the tossing portion of the lever resting at or near the ground;

raising a foot to force a foot portion of the first arm of the lever to the ground, actuating the lever and thereby tossing the ball into the air, wherein the tossing portion comprises two or more fingers comprising contoured distal ends configured to release the ball substantially vertically.

6. The method of claim 5, further comprising:

releasing the thumb screw from the first and second fastening apertures;

pivoting the second arm in relation to the first arm via the pivot rod until the second arm is received in the channel and abuts the first arm to thereby be in a closed position; and inserting the thumb screw into the first fastening aperture for storage.

* * * * *